US005845709A

United States Patent [19]

Mack et al.

[11] Patent Number: 5,845,709

[45] Date of Patent: Dec. 8, 1998

[54] RECIRCULATING PUMP FOR ELECTRICAL SUBMERSIBLE PUMP SYSTEM

[75] Inventors: John J. Mack; Brown Lyle Wilson, both of Tulsa, Okla.

[73] Assignee: Baker Hughes Incorporated, Houston, Tex.

[21] Appl. No.: 587,011

[22] Filed: Jan. 16, 1996

[51] Int. Cl.[6] ..... E21B 43/16; E21B 43/38

[52] U.S. Cl. ..... 166/302; 166/57; 166/105.5; 166/369; 417/370; 417/423.8

[58] Field of Search ..... 166/105, 369, 166/57, 302, 105.5; 417/368, 369, 370, 423.8, 424.2

[56] References Cited

U.S. PATENT DOCUMENTS

| | | | |
|---|---|---|---|
| 2,280,087 | 4/1942 | Hollander et al. | 417/423.8 |
| 2,310,757 | 2/1943 | Wagner | 166/65.1 |
| 2,809,590 | 10/1957 | Brown | 417/370 X |
| 4,487,257 | 12/1984 | Dauphine | 166/65.1 X |
| 4,553,909 | 11/1985 | Galais et al. | 417/369 |
| 4,580,634 | 4/1986 | Cruise et al. | 166/310 |
| 4,582,131 | 4/1986 | Plummer et al. | 166/68 |
| 4,616,704 | 10/1986 | Johnston | 166/242.3 |
| 4,643,258 | 2/1987 | Kime | 166/105.5 X |
| 4,749,034 | 6/1988 | Vandevier et al. | 166/105 |
| 4,913,239 | 4/1990 | Bayh, III | 166/385 |
| 4,981,175 | 1/1991 | Powers | 166/265 |
| 5,554,897 | 9/1996 | Martin et al. | 417/423.8 |

FOREIGN PATENT DOCUMENTS

| | | | |
|---|---|---|---|
| 668607 | 10/1979 | Russian Federation | 166/105 |
| 1476199 | 4/1989 | Russian Federation | 417/369 |
| 1652470 | 5/1991 | Russian Federation | 166/105 |

OTHER PUBLICATIONS

R. W. Cramer, Chevron U.S.A. Inc. and J. L. Bearden, Centrilift–Hughes, copyright 1985, *Development and Application of a Downhole Chemical Injection Pump for Use in ESP Applications*.

*Primary Examiner*—Hoang Dang
*Attorney, Agent, or Firm*—James E. Bradley

[57] ABSTRACT

An electrical submersible pump (ESP) having tubing for recirculating fluid below the motor of the ESP for cooling purposes. By recirculating fluid below the motor, an ESP can then be placed below the perforations in a well casing, thereby taking advantage of gas separation from the fluid before the fluid enters the pump intake. Three embodiments are disclosed: a fluid tap in the production pump housing to which tubing is connected to recirculate the fluid; a recirculation pump that shares an intake with the production pump wherein the recirculation pump is used to recirculate the fluid; and a recirculation pump and a production pump that each have a separate intake wherein the recirculation pump is used to recirculate the fluid.

18 Claims, 8 Drawing Sheets

RECIRCULATING PUMP FOR ELECTRICAL SUBMERSIBLE PUMP SYSTEM

BACKGROUND OF THE INVENTION

1. Field of the Invention

The present invention relates to submersible pumps, in more particular the invention relates to an electrical submersible pump employing a recirculation means to use a portion of the fluid produced by the electrical submersible pump and deliver the fluid to a location below and outside the motor of the electrical submersible pump.

2. Prior Art

The fluid in many producing oil and/or gas wells is elevated to the surface of the ground by the action of a pumping unit or a pumping apparatus installed in the lower portion of the well bore. In recent times there has been increased activity in the drilling of well bores to great depths. The use of water flooding as a means of secondary recovery of oil or other hydrocarbon fluids, after the production thereof has been somewhat depleted, is commonly practiced. Because water flooding produces a considerable quantity of fluid in the producing well bore it is preferable to provide a downhole pumping system capable of producing large quantities of fluid. Electrical submersible pump (ESP) systems have been found to meet this need. However, the electric motor used in such systems generate considerable heat and are typically cooled by the transfer of heat to the surrounding annular fluids. In many cases, the pumping unit is generally set above perforations in the well casing that are located in the well's producing zone. By placing the pumping unit above the perforations, the unit can make use of the flowing well fluid to produce some convection cooling about the motor. Insufficient fluid velocity, however, will cause the motor to overheat and will lead to early motor failure.

Fluid produced by the pumping unit consists of formation water, oil and quantities of gas. The gas can be significant because it inhibits the pump from producing liquid. This results in gas blocking, or locking, and equipment failure will result if a unit is not shut down quickly thereafter. It is therefore desirable to place the pump below the well casing perforations to take advantage of the natural annular separation of the gas from the liquid. However, by placing the pump below the casing perforations, the motor of the pumping unit is not exposed to flowing well fluid that normally provides some cooling to the ESP. As a result, a pumping unit placed below the casing perforations will overheat and experience a shortened operational life unless a means for circulating fluid over the surface of the motor is provided.

SUMMARY OF THE INVENTION

It is therefore an object of the invention to provide an electrical submersible pump (ESP) with a means for recirculating a portion of the fluid produced by the pumping unit to a location at or below the motor of the pumping unit. By recirculating the fluid to a point below or surrounding the motor of the pumping unit, the fluid can then flow over the outside of the motor and into the pump intake, and thereby provide forced convection cooling.

The present invention contemplates locating a recirculation pump or a recirculation fluid tap in an electrical submersible pump to recirculate a portion of the fluid to a location below or surrounding the motor of the pumping unit. The general construction of an ESP uses a motor on the bottom and a pump on the top. Between the motor section and the pump section is a protective structure that provides a location for four necessary functions: a shaft seal, an equalizing element to balance the internal pressure of the motor with that of the wellbore, an expansion chamber, and a thrust bearing. In the preferred embodiment, the recirculation pump or fluid tap of this invention is located directly proximate the pump section of the electrical submersible pump.

The invention can be applied in several different forms. One method is an embodiment having a single fluid intake The recirculation pump in the single intake embodiment is typically affixed to a multi-stage centrifugal pump. A multi-stage centrifugal pump is comprised of pumping stages that are stacked together inside of the pumping unit. The stages are comprised of diffusers and impellers and are used to develop a greater head at a given capacity. In the single fluid intake embodiment, the recirculation pump and the production pump share the same fluid intake. A major advantage to this system is that the fluid sent downward past the motor is continually being replaced with new fluid being drawn in from the annulus, thereby allowing for better cooling of the motor.

A second embodiment of the invention uses a double intake. In this method, the recirculation pump is attached to a standard production pump. Each of the recirculation pump and the production pump has a separate intake. In the double intake embodiment, all of the fluid produced by the recirculation pump is directed downwardly past the motor.

Finally, a third embodiment is comprised of a fluid tap through the production pump housing at a location near the bottom of the production pump. In this method, a portion of the fluid produced by the production pump is redirected to a point below the motor of the submersible pump. A centrifugal pump, which is the type of pump normally used in an ESP, produces pressure in relation to the volume flowing through the pump. Centrifugal pumps often consist of one or more stages. The volume of fluid flowing through a stage increases as the pressure is reduced. The invention makes use of this fact by tapping off a portion of the fluid for recirculation, at a location above the pump intake. The location is selected as one having adequate pressure to recirculate the required fluid volume for motor cooling. This volume is then transported through a tube to a location below the motor.

The fluid to be recirculated should be of a volume sufficient to produce the necessary fluid flow velocity past the motor. (API recommends a fluid velocity of 1 ft/sec). It is also preferable to use pressures as low as possible and recirculation tubing with no small openings that could result in plugging of the tube.

Thus it is a principal object of this invention to provide means whereby cooling fluid is recirculated through a tube to a location below or contiguous to the motor of the ESP. The tubing required for such recirculation systems will reach from the location of the recirculation pump, or fluid tap, to a point below the motor of the ESP. The tube should be large enough in diameter that it will not be easily plugged with debris, asphaltines, or scale, yet small enough to provide adequate clearance between the outside diameter of the motor and the inside diameter of the well casing. For example, in wells using a 5.5" casing, the clearance is just slightly over a quarter of an inch for 17 #/ft casing. Due to the narrow clearance, this invention provides an elongated, or flattened, tube profile that conforms to the annulus between the motor and casing. A more preferred embodiment utilizes protective support rods attached proximate to each side of the tube to prevent the tube from kinking and to lessen the chances of damage to the tube while the unit is being installed into the well. In installations with a large motor/casing clearance, the special tube shape is not necessary.

Various types of tube construction are acceptable and the following listed tube types are for example only and are not intended to limit the scope of the invention. Reinforced tubes are useful in tight casings and also when used in deviated wells. Tubes which require spot welds or seam welds may be utilized. These welds are necessary to prevent pressure loss during the displacement of fluid to below the motor for cooling. In applications where the risk of crushing damage is low, for example in applications with a large casing diameter, a flattened tube profile without rods or reinforcements may be used. Additionally, an extruded tube may be utilized thereby eliminating the need to assemble sections of the tube together. This type of tube may be extruded with an internal reinforcing member to prevent crushing. Additional tubing profiles that could be used are round tubes, square tubes, and rectangular tubes. These latter profiles would preferably be used in applications where clearance is not the main concern or where more fluid needs to be moved past the motor.

DETAILED DESCRIPTION OF THE PREFERRED EMBODIMENTS

Figure 1:
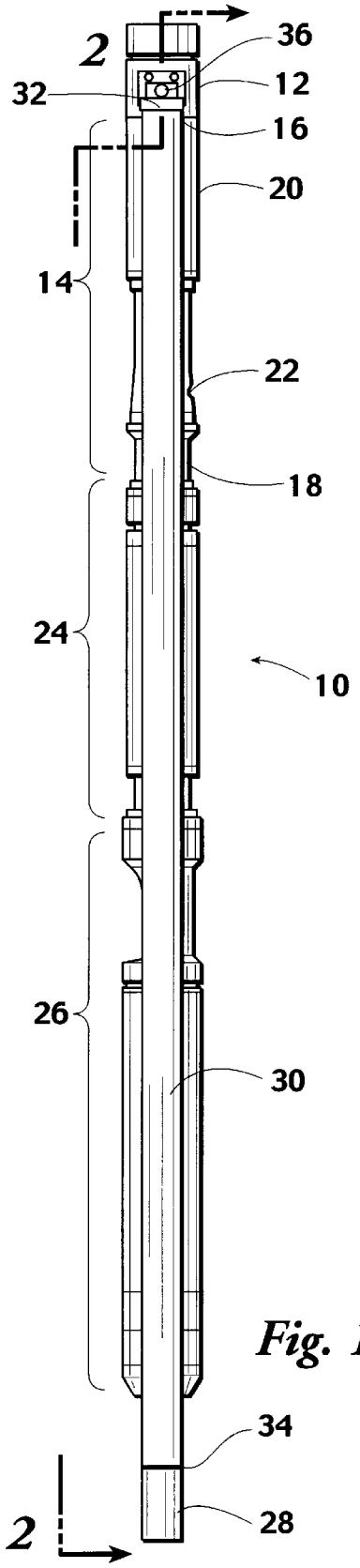
FIG. 1 is a plan view of a single intake ESP and recirculation pump.

Referring to FIG. 1, an Electrical Submersible Pump (ESP) and separate recirculating pump assembly is shown. The ESP assembly is generally designated by the numeral 10. A recirculation pump head 12 is affixed to recirculation pump 14. Recirculation pump 14 has a top end 16, a bottom end 18, and a housing 20. Recirculation pump 14 is typically a centrifugal pump similar to the pump shown in FIG. 4 with a recirculation pump intake 22 to receive annular well fluids. Seal or equalizer section 24 is affixed to bottom 18 of recirculation pump 14. A typical motor and seal section is shown in U.S. Pat. No. 2,315,917 and 2,270,666. Electrical submersible pump motor 26 is affixed to seal section 24 and drives recirculation pump 14 by means of an internal co-axial pump shaft (not shown). Lower extension member tube 28 is affixed to motor 26 and provides a location to retain recirculation tubing 30 so that recirculation tubing 30 does not become damaged during down-hole installation of ESP assembly 10. Recirculation tubing 30 has upper end 32 and lower end 34. The upper end 32 is connected to tubing cap 36 for communication with the pumped production fluids. The produced fluids are transported down recirculation tube 30 and out of recirculation tubing lower end 34 into annulus 35 between ESP assembly 10 and casing 37. The fluid is then drawn up the outside of motor 26 and seal section 24 and into intake 22. The recirculated fluid passing over the outside of motor 26 provides cooling for motor 26.

Figure 2:
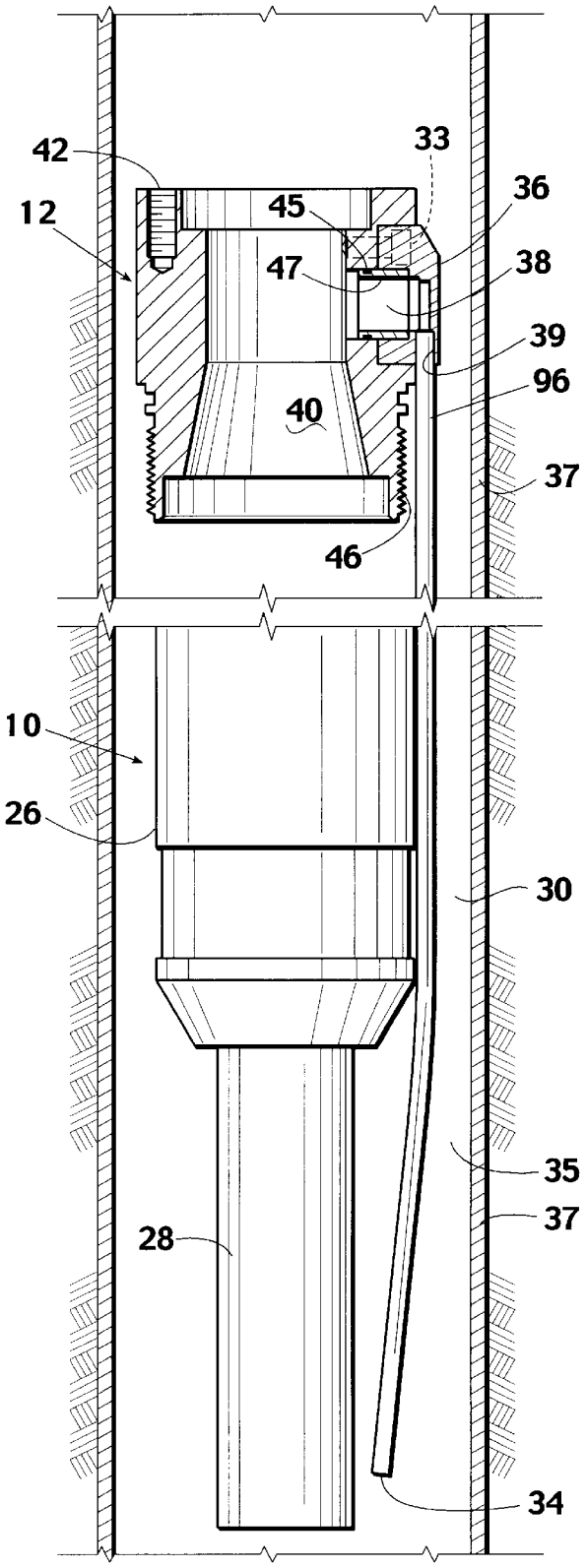
FIG. 2 is a partial cut away view of the pump head and recirculating tube of the system of FIG. 1.

Recirculation pump head 12 is shown in greater detail in FIG. 2. Tubing cap 36 is affixed to recirculation pump head 12 by tubing cap bolt 33. Fluid conduit 38 communicates with recirculation tubing upper end 32 and recirculation pump fluid cavity 40. Recirculation pump head 12 is connected to an ESP pump (not shown in FIG. 1) which is affixed thereto by bolts that are received in bolt holes 42. O-ring 45 is provided within tubing cap sleeve 47 to facilitate a good seal. Recirculation pump head 12 is preferably affixed to a centrifugal recirculation pump 14 (not shown in FIG. 2) by means of threads 46. Flat profile tubing cap 36 is provided with recirculation tubing receiver 39.

Figure 3:
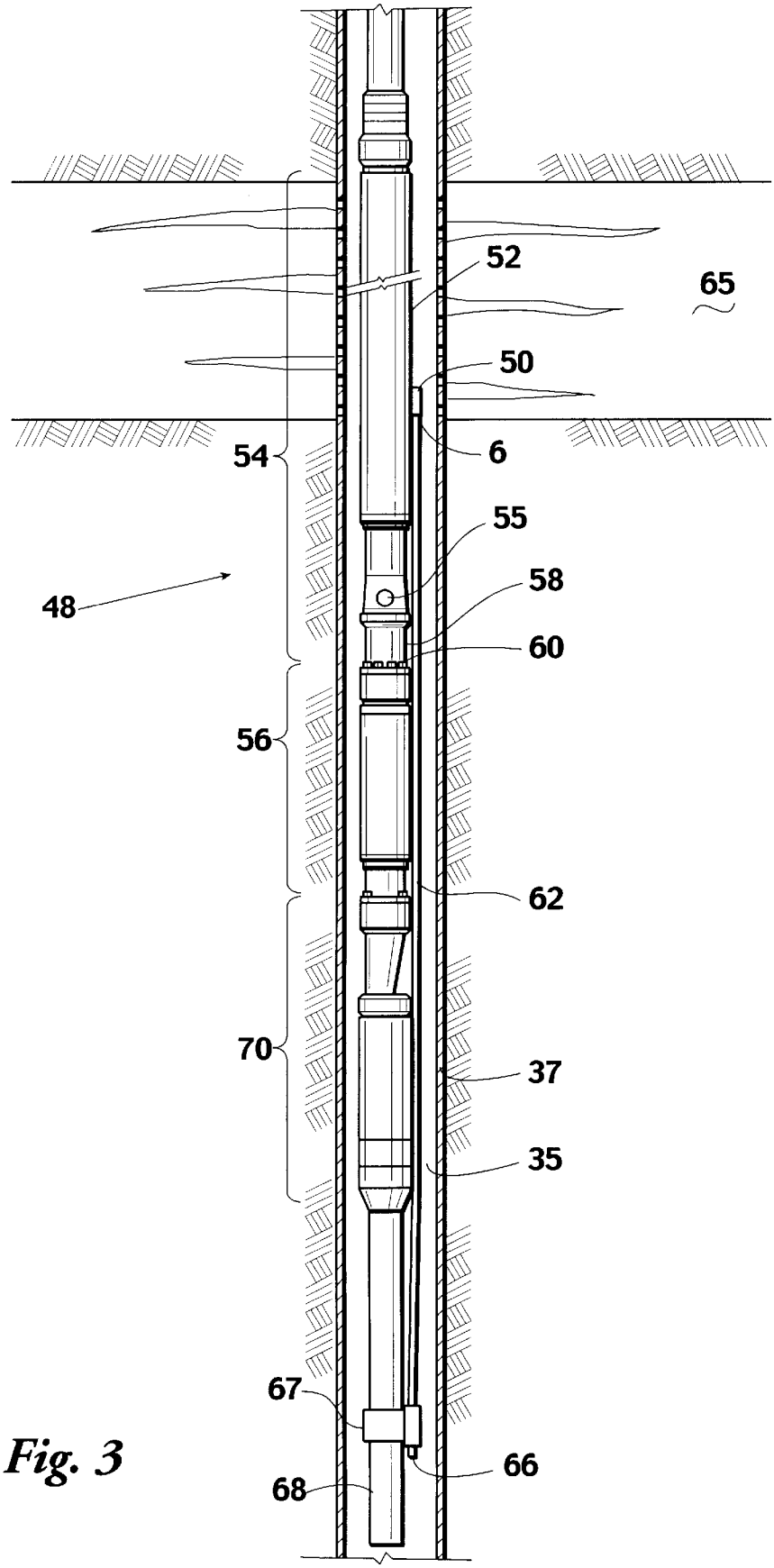
FIG. 3 is a plan view of another embodiment of a single intake ESP and recirculation pump.

FIG. 3 shows another embodiment of an ESP system designated generally 48. In this embodiment the ESP system comprises motor section 70, equalizer section 56 and pump section 54, the latter formed of housing 52. A recirculation fluid tap 50 communicates with the pumped fluids inside housing 52 of the multi-stage centrifugal pump. Pump 54 draws in fluid through fluid intake 55. Seal section 56 (a/k/a equalizer or protector) is attached to bottom end 58 of ESP pump 54 by bolts 60. Recirculation tube 62 has first inlet end 64 that is affixed to fluid tap 50. Fluid tap 50 communicates with the centrifugal pump impeller/diffusion chamber. Recirculation tube 62 terminates at a second end 66 where clamp 67 affixes it to base extension tube 68. Power supply to the ESP motor 70 is supplied by a cable from the surface as is well known in the art but not shown here. In this embodiment the ESP system is located below producing formation 65.

Figure 4:
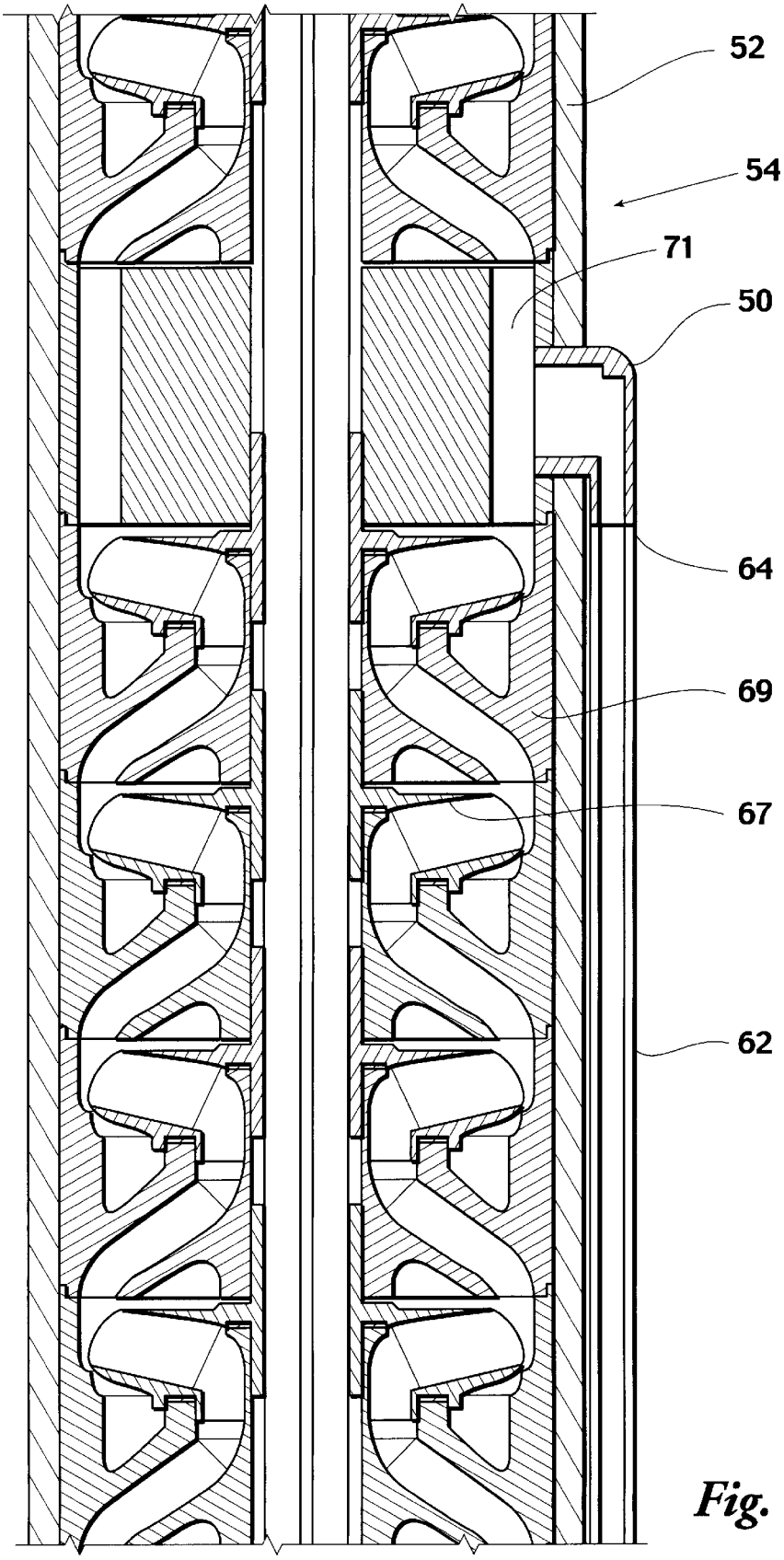
FIG. 4 is a cross-sectional view of a recirculating flow conduit as a part of a centrifugal pump.

FIG. 4 is a cross-sectional view of a typical multi-stage centrifugal pump section 54. The volume of fluid flowing through a stage increases as the pressure is reduced. Fluid tap 50 is positioned to tap off a portion of fluid at an adequate pressure to recirculate the required fluid volume down recirculation tube 62 for cooling ESP motor 70 (shown in FIG. 3). Each stage of pump 54 is comprised of impellers 67 and diffusers 69. Area 71 is provided without impellers 67 and diffusers 69 to provide an area for receiving the pumped fluid and to locate fluid tap 50.

Figure 5:
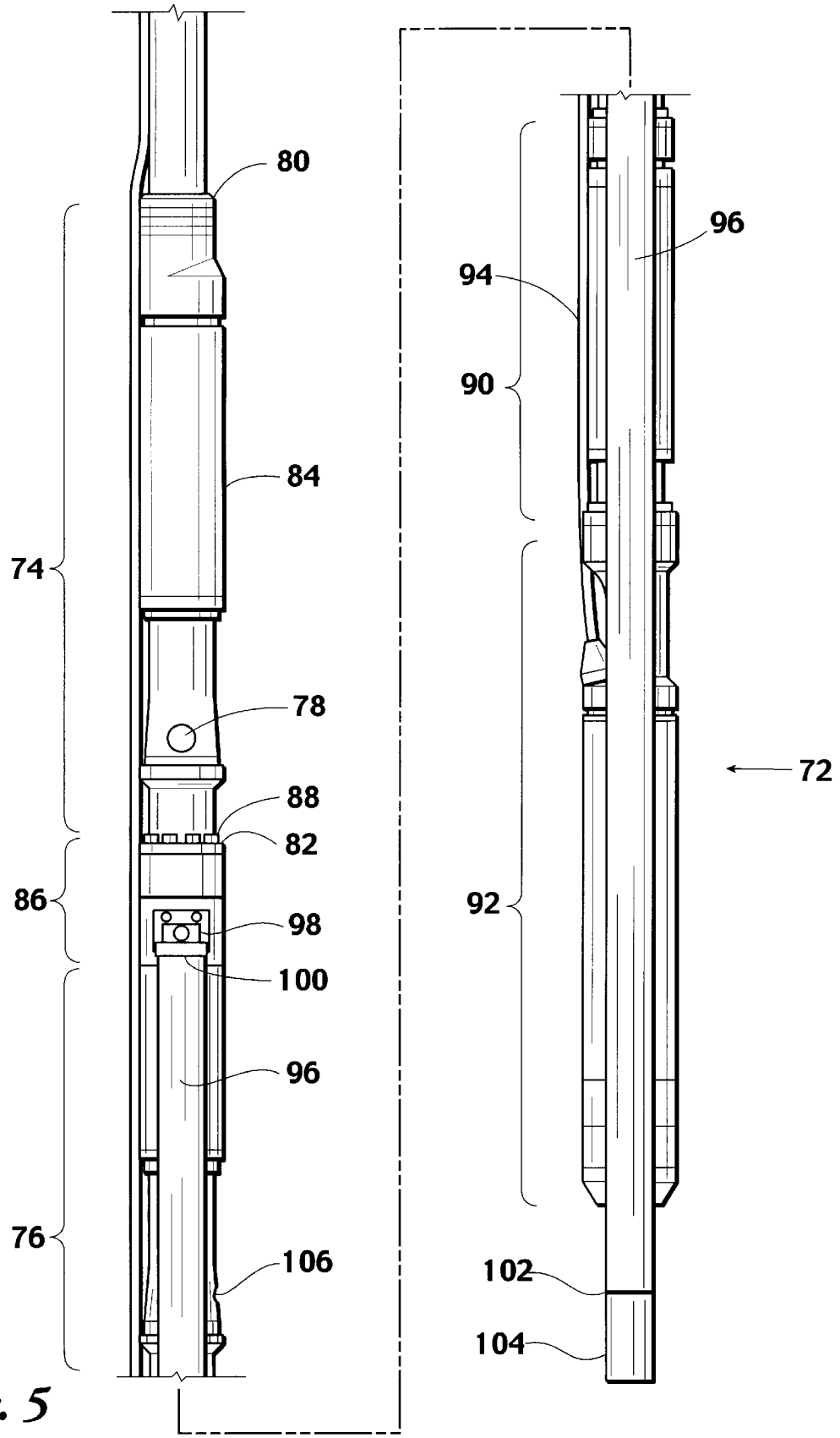
FIG. 5 is a plan view of an ESP and a separate recirculation pump.

Referring to FIG. 5, a third embodiment is an ESP designated generally 72 having a motor section 92, an equalizer section 90, a recirculating pump section 76, a pump head section 86 and a production pump section 74. A separate production pump intake 78 is provided for production pump 74 and separate recirculation pump intake 106 is provided for recirculation pump 76. ESP production pump 74 has a top end 80, a bottom end 82, and a housing 84 and is affixed to recirculation pump head 86 by means of bolts 88. Recirculation pump 76 is affixed between recirculation pump head 86 and seal section 90. Seal section 90, in turn, connects with motor 92. Power from the surface of a well is provided to motor 92 by means of flat cable 94. Recirculation tubing 96 communicates with the outlet conduit of recirculation pump head 86 by means of tubing cap 98 that is attached to a first end 100 of tubing 96. Second end 102 of recirculation tubing 96 terminates below motor 92 and is preferably affixed to an extension member 104 that is attached to motor section 92. By providing recirculation pump 76 with separate recirculation pump intake 106, all of the fluid produced by recirculation pump 76 is circulated downward into the annulus below the motor. The fluid then flows upward past motor 92, where it is drawn in by recirculation intake 106.

Figure 6:
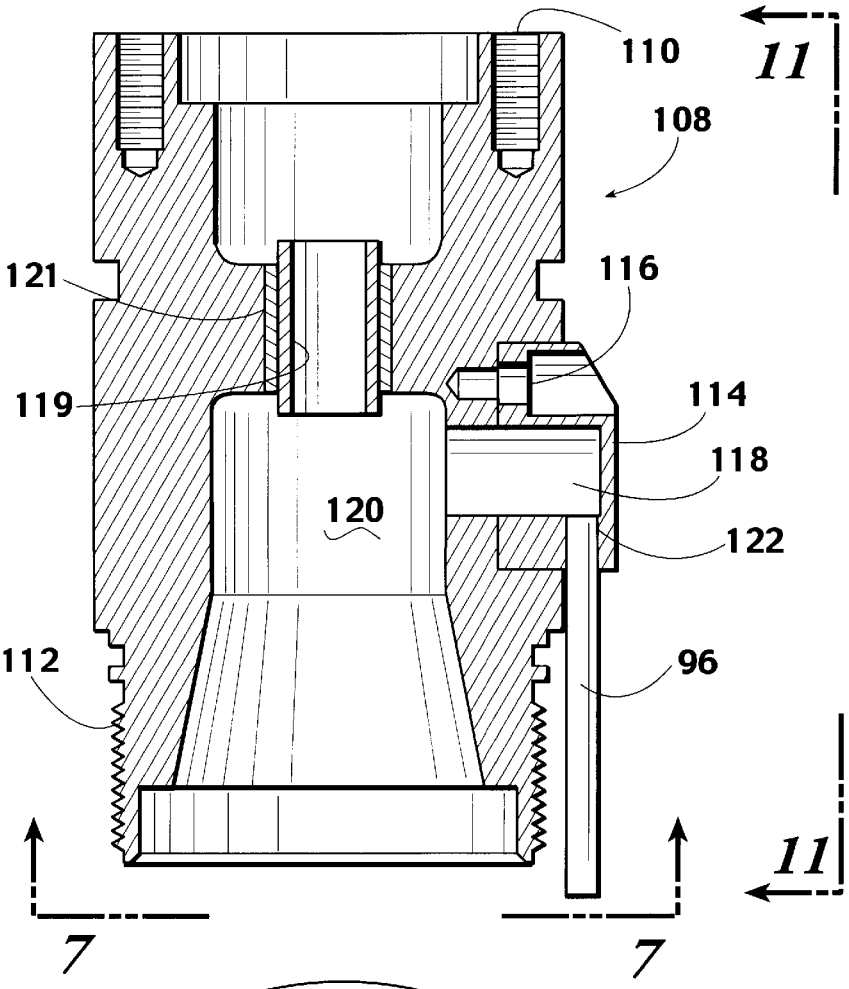
FIG. 6 is an enlarged cross-sectional view of one form of a recirculation pump head.
Figure 7:
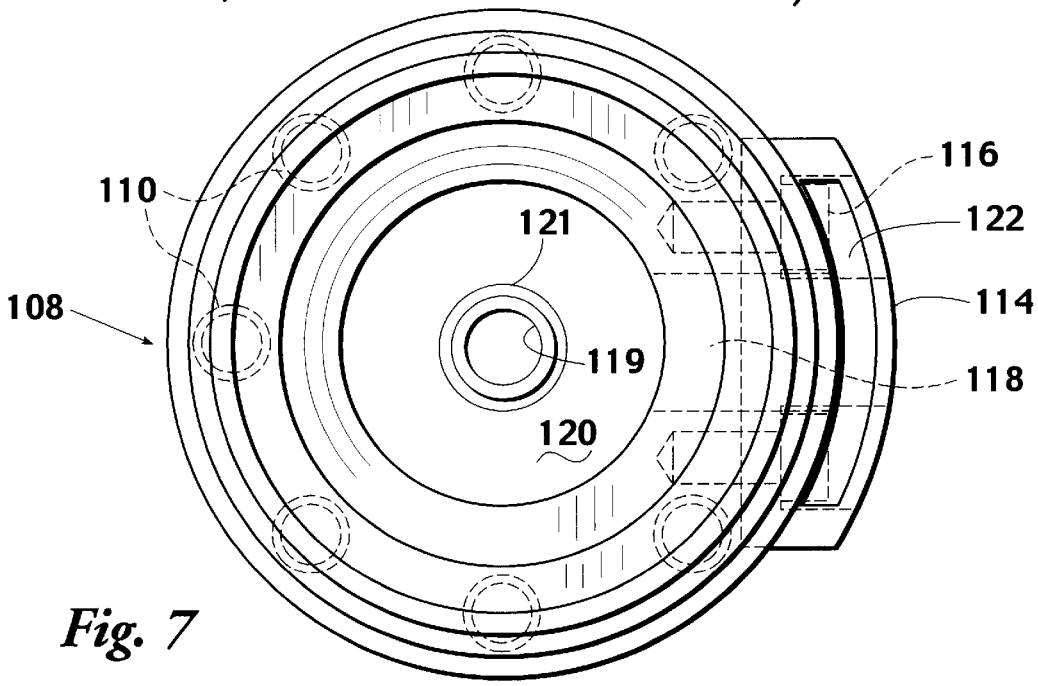
FIG. 7 is a bottom view of the recirculation pump head of FIG. 6.

FIGS. 6 and 7 show a recirculation pump head for use with a double intake system such as the system shown in FIG. 5. The recirculation pump head is designated generally 108. Bolt holes 110 are provided to affix recirculation pump head 108 to an ESP pump. Similarly, threads 112 are provided to affix recirculation pump head 108 to the housing of recirculation pump 76 as recirculation pump head 86 is shown affixed to recirculation pump 76 shown in FIG. 5. Tubing cap 114 is affixed to recirculation pump head 108 by means of tubing cap bolt 116. Fluid conduit 118 communicates with fluid cavity 120 and with recirculation tubing receiver 122, thereby providing a means for fluid to exit fluid cavity 120 and be transported by recirculation tubing 96 to a point below the motor of the ESP. Shaft sleeve 119 is provided in recirculation pump head 108 to accommodate the pump shaft (not shown) that rotates in sleeve bushing 121. The pump shaft drives not only recirculation pump 76 but also ESP production pump 74. Tubing cap 114 is formed as an arcuate flattened shape to conform with the annular space between ESP 72 and the well casing.

Figure 8:
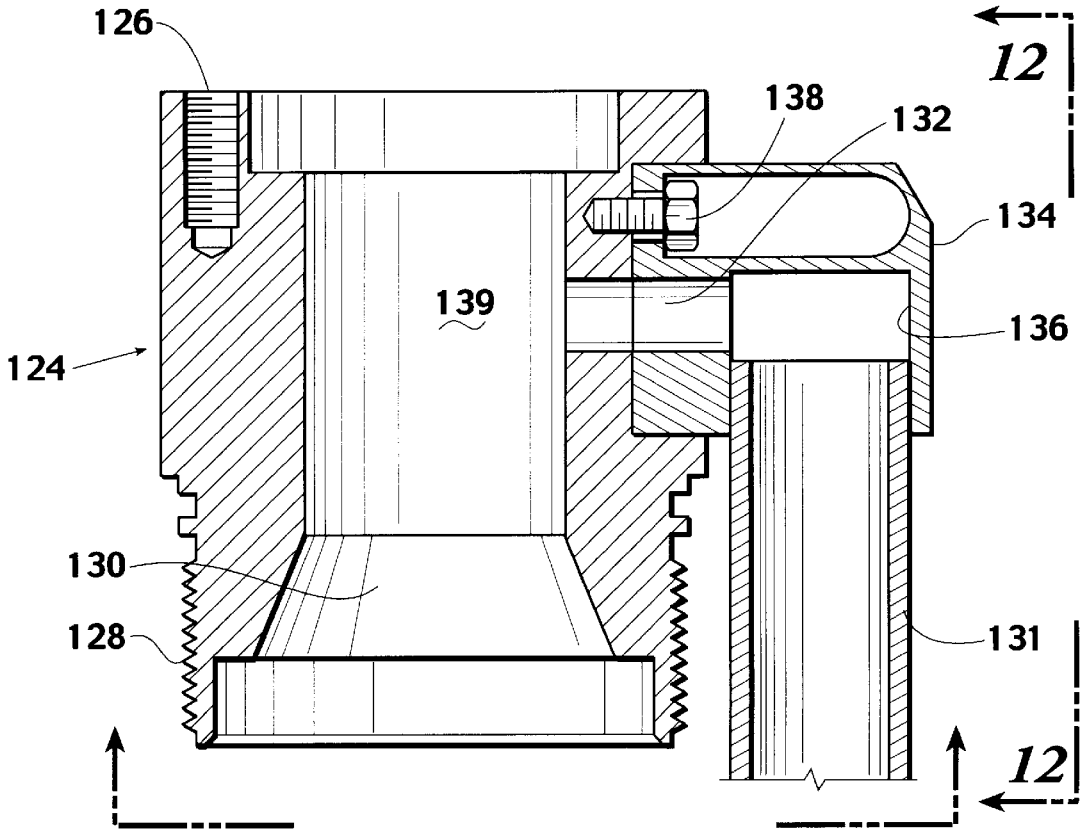
FIG. 8 is a cross-sectional view of another form of recirculation pump head.
Figure 9:
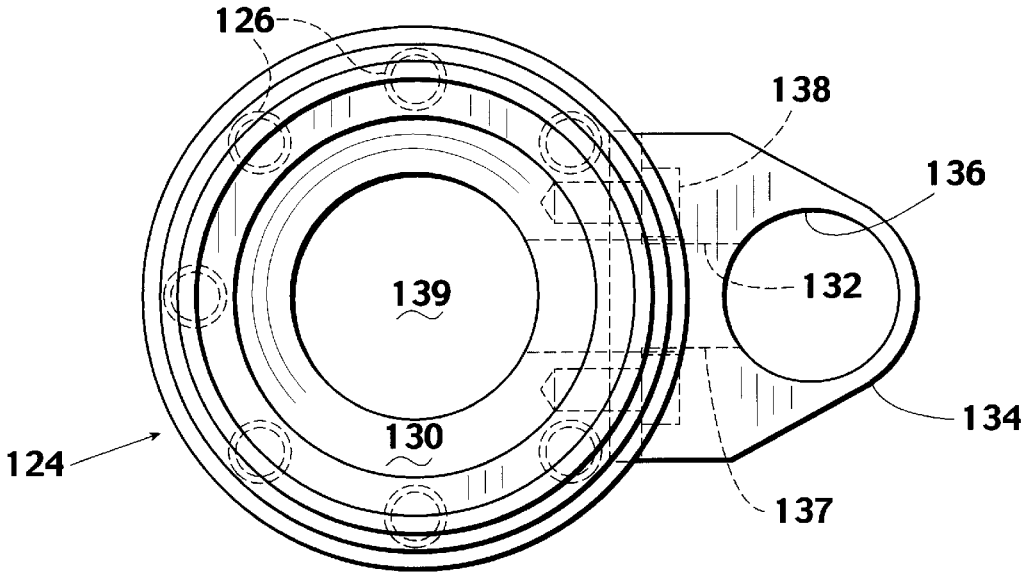
FIG. 9 is a bottom view of the recirculation pump head of FIG. 8.

Another form of recirculation pump head 124 is shown in FIGS. 8 and 9. Bolt holes 126 are provided to secure recirculation pump head 124 to an ESP pump. Threads 128 are provided to affix recirculation pump head 124 to the housing of recirculation pump 76 as recirculation pump head 86 is shown affixed to recirculation pump 76 shown in FIG. 5. In this embodiment, fluid cavity 130 communicates with round recirculation tubing 131 via fluid conduit 132. Round tubing cap 134 must be of a size sufficient to accommodate round recirculation tubing 131 yet be passable into the well annulus without damage. Tubing cap 134 is secured to recirculation pump head 124 by means of tubing cap bolts 138. The use of round recirculation tubing 131 is limited to applications where the clearance between the inner diameter of the well casing and the outer diameter of the ESP is substantial. Bolt holes 126 are for receiving bolts to affix recirculation pump head 124 to an ESP pump. As shown in FIG. 9, fluid cavity 130 is in communication with recirculation tubing receiver 136 by means of fluid conduit 132. Tubing cap bolts 138 secure round tubing cap 134 to the recirculation pump head 124. Aperture 139 allows a pump shaft to pass therethrough.

Figure 10A:
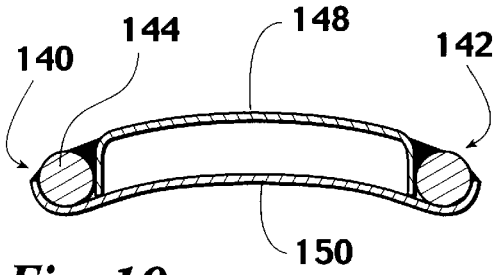
FIGS. 10(*a–s*) are cross-sectional views of various recirculation tube embodiments.
Figure 10B:
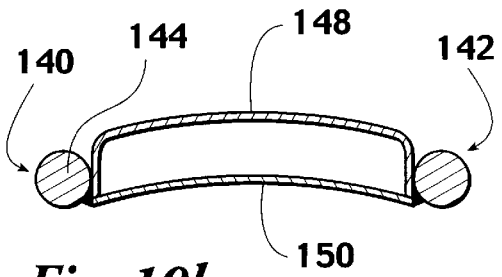
Figure 10C:
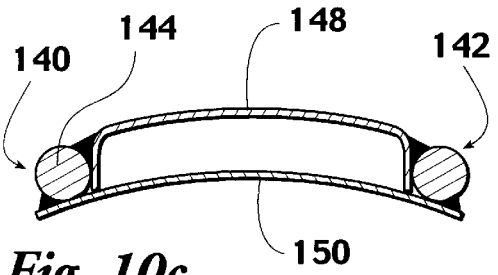
Figure 10D:
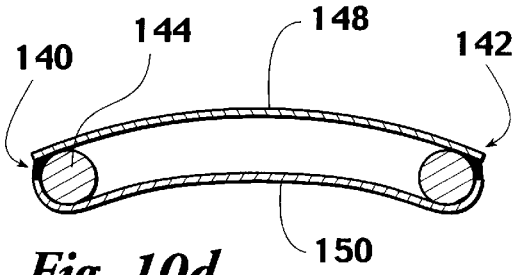
Figure 10E:
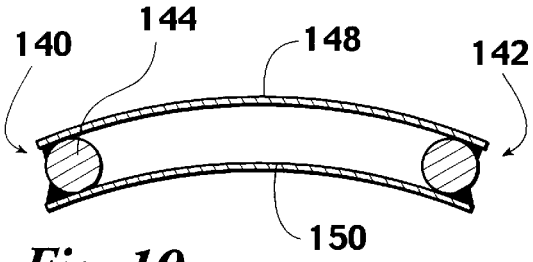
Figure 10F:
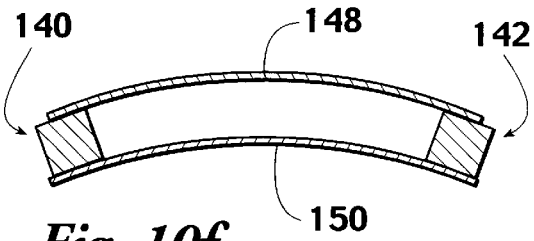
Figure 10G:
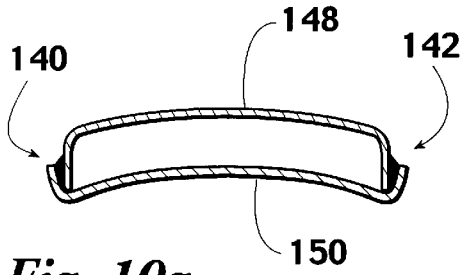
Figure 10H:
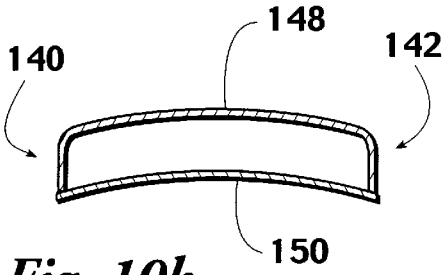
Figure 10J:
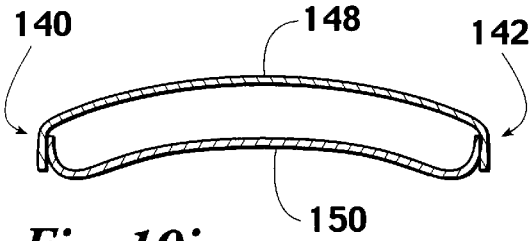
Figure 10K:
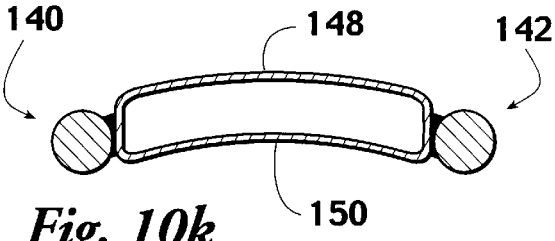
Figure 10L:
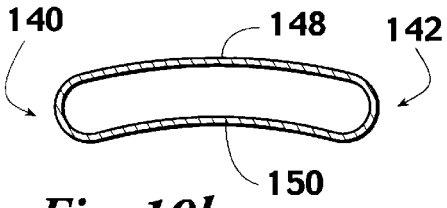
Figure 10M:
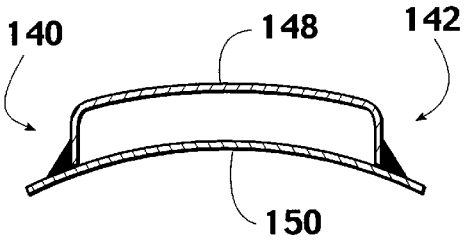
Figure 10N:
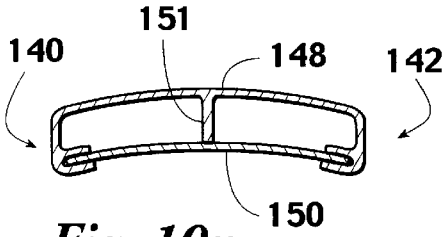
Figure 10P:
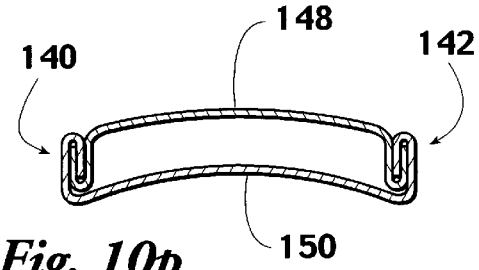
Figure 10R:
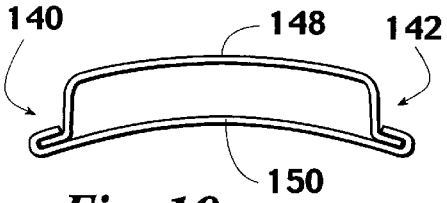
Figure 10S:
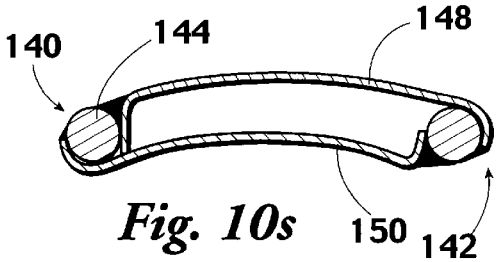

FIGS. 10*a–s* show various embodiments of flattened tubing profiles. The flattened tube profiles are curved to conform to the cylindrical housing of the ESP. Embodiments 10*a*–10*f* and 10*s* are flat tubes the sides of which are reinforced with parallel rods 144 located at first side 140 and second side 142. The purpose of the rods is to prevent crushing and kinking of the tubes during installation and removal from a well in tight casing and deviated wells. Round reinforcing rods 144 are shown in embodiments 10*a*–10*e* and 10*s*, while square reinforcing rods 146 are shown in FIG. 10*f*.

FIGS. 10*a*, 10*b*, and 10*c* show reinforced tubes wherein the reinforcing rods are on the outside of the tube. FIG. 10*d* shows an embodiment wherein the reinforcing rods are on the inside of the tube and FIGS. 10*e* and 10*f* show reinforcing rods which are integral with said tube. FIG. 10*k* shows an additional embodiment with reinforcing rows. Tubing profiles depicted in drawings 10*a*–10*s* and 10*m* are profiles requiring spot welds or seam welds to assemble and that provide protective support in lieu of rods. These welds are required to prevent pressure loss during the displacement of fluid to below the motor for cooling purposes. Each of the tubes is provided with outer piece 148 and inner piece 150 that form the walls of the flat tube. FIG. 10*n* shows a tube having an extruded profile with an interior reinforcing member 151. An extruded tube eliminates the need to assemble sections of tubing together. FIGS. 10*l* and 10*r* show tubing that is acceptable for use in low pressure applications where the risk of crushing damage is low. An example of a type of application where the risk of crushing damage is low is an ESP application in a large casing. Tubing profiles that are not shown that could be used are round, square and rectangular tube profiles. These profiles would be used in applications where clearance is not the main concern, or where more fluid needs to be circulated below the motor.

Figure 11:
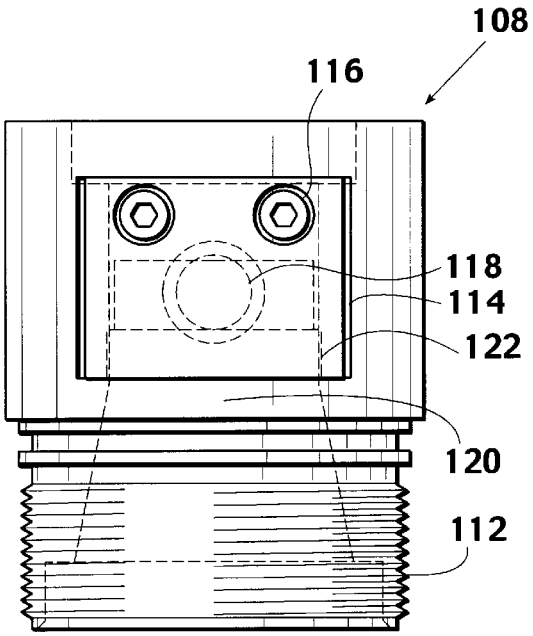
FIG. 11 is a plan view of a recirculation pump head.

FIG. 11 shows an elevational view of recirculation pump head 108 as shown in FIGS. 6 and 7. Visible is the flat profile tubing cap 114 and tubing cap bolts 116. Also visible are threads 112. Flat profile tubing cap 114 is provided with fluid conduit 118 that communicates with fluid cavity 120. Flat profile tubing cap 114 is provided with recirculation tubing receiver 122.

Figure 12:
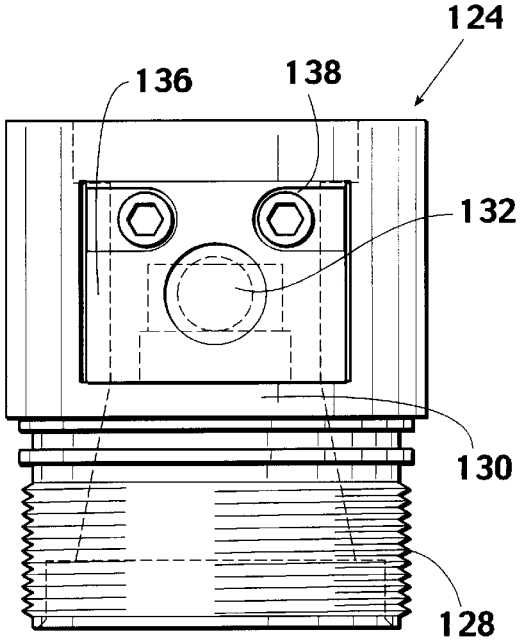
FIG. 12 is a plan view of a recirculation pump head.

FIG. 12 is an elevational view of the recirculation pump head 124 as shown in FIGS. 8 and 9. Visible are threads 128 and round tubing cap 136. Round tubing cap 136 is affixed to recirculation pump head 124 by means of tubing cap bolts 138. Also visible is fluid conduit 132 that communicates with fluid cavity 130.

Whereas, the present invention has been described in relation to the drawings attached hereto, it should be understood that other and further modifications, apart from those shown or suggested herein, may be made within the spirit and scope of this invention.

What is claimed is:

1. A well comprising:

a centrifugal pump having a top, a bottom and a housing;

an electric motor operatively connected with said pump and located below said pump, said motor having a housing;

a casing positioned in said well, said casing having perforations for ingress of gas and liquid from an earth formation, said pump and motor being positioned below said perforations to take advantage of natural annular separation of gas from liquid;

a fluid tap through said pump housing of said pump; and a tube for transporting fluid from said fluid tap downwardly to a location contiguous to or below said motor and exiting the fluid from a terminal end of said tube for facilitating a fluid flow proximate said motor, said fluid flow having a velocity sufficient to adequately cool said motor wherein said fluid flow passes over said motor and flows upwardly at least to said pump.

2. A well according to claim 1 wherein said tube for transporting fluid has a flattened profile of an arcuate shape that conforms to said motor housing.

3. A well according to claim 1 wherein said tube has a tube protective member positioned along a length of said tube.

4. A well according to claim 1 wherein said tube for transporting fluid has a flattened profile having first and second vertical sides and which is protected from damage from contact with objects such as a well casing as the pump and motor are lowered into the well.

5. A well according to claim 1 further comprising a recirculation pump located between said pump and said motor.

6. A well comprising:

a production pump having a top, a bottom, and a cylindrical housing, said production pump positioned at a first end of a submersible pumping unit;

an electric motor having a housing, said motor operatively connected with said pump and positioned at a second end of said submersible pumping unit;

a casing positioned in said well, said casing having perforations for ingress of gas and liquid from an earth formation, said pump and motor being positioned below said perforations to take advantage of natural annular separation of gas from liquid;

a recirculation pump located between said pump and said motor; and a tube for transporting fluid from said recirculation pump to a location contiguous to or below said electric motor for facilitating a fluid flow proximate said motor, said fluid flow having a velocity sufficient to adequately cool said motor wherein said fluid flow passes over said motor and flows upwardly at least to said pump wherein said tube has a reinforcing member positioned along a length of said tube.

7. A well according to claim 6 wherein said tube for transporting fluid has a flattened profile having first and second reinforced sides.

8. A well according to claim 6 wherein said recirculation pump has a recirculation intake thereon.

9. A well according to claim 6 wherein said tube has a flattened profile having a first and second side and a reinforcing member positioned along a length of said tube.

10. A well according to claim 6 wherein said tube for transporting fluid has a flattened profile having a first and second side and which is reinforced with a reinforcing member.

11. A method of producing fluid from a subsurface well, which has a casing and perforations for ingress of liquid and gas from a formation, said method comprising the steps of:

positioning an electrical centrifugal submersible pump below said perforations for avoiding gas locking of said electrical submersible pump, said electrical submersible pump having a submersible motor;

providing a re-circulating system on said electrical submersible pump; and pumping a portion of fluid produced by said re-circulating system to a point contiguous to or below said motor to cool said motor.

12. A method of producing fluid from a subsurface well according to claim 11 wherein said re-circulating system comprises a fluid tap through said pump housing of said pump.

13. A method of producing fluid from a subsurface well according to claim 11 wherein said re-circulating system comprises a recirculation pump located between said pump and said motor.

14. A well comprising:

a centrifugal pump having a top, a bottom and a housing;

an electric motor operatively connected with said pump and located below said pump, said motor having a housing;

a casing positioned in said well, said casing having perforations for ingress of gas and liquid from an earth formation, said pump and motor being positioned below said perforations to take advantage of natural annular separation of gas from liquid;

a fluid tap through said pump housing of said pump; and a substantially vertical tube on one side of said motor for transporting fluid from said fluid tap downwardly to a location contiguous to or below said motor and exiting the fluid from a terminal end of said tube for facilitating a fluid flow proximate said motor, said fluid flow having a velocity sufficient to adequately cool said motor wherein said fluid flow passes over said motor and flows upwardly at least to said pump.

15. A well according to claim 14 wherein said tube for transporting fluid has a flattened profile of an arcuate shape that conforms to said cylindrical motor housing.

16. A well according to claim 14 wherein said tube has a tube protective member positioned along a length of said tube.

17. A well according to claim 14 wherein said tube for transporting fluid has a flattened profile having first and second vertical sides and which is protected from damage from contact with objects such as a well casing as the pump and motor are lowered into the well.

18. A well according to claim 14 further comprising a recirculation pump located between said pump and said motor.

* * * * *